US005706529A

United States Patent [19]

Kai et al.

[11] Patent Number: 5,706,529

[45] Date of Patent: Jan. 13, 1998

[54] WATER CLOSET

[75] Inventors: Yoshio Kai; Toshifumi Yoneda, both of Fukuoka-ken, Japan

[73] Assignee: Toto Ltd., Fukuoka-ken, Japan

[21] Appl. No.: 633,656

[22] Filed: Apr. 17, 1996

Related U.S. Application Data

[63] Continuation of Ser. No. 332,505, Oct. 31, 1994, abandoned, which is a continuation of Ser. No. 939,932, Sep. 2, 1992, abandoned, which is a continuation of Ser. No. 660,234, Feb. 25, 1991, Pat. No. 5,170,515, which is a continuation of Ser. No. 362,404, filed as PCT/JP88/00944, Sep. 16, 1988, abandoned.

[30] Foreign Application Priority Data

Sep. 16, 1987 [JP] Japan ..... 62-233445

[51] Int. Cl.[6] ..... E03D 1/08

[52] U.S. Cl. ..... 4/370; 4/369; 4/428; 4/421

[58] Field of Search ..... 4/329, 332, 421, 4/428, 370, 419, 369, 368, 372

[56] References Cited

U.S. PATENT DOCUMENTS

| | | | |
|---|---|---|---|
| 1,062,413 | 5/1913 | Payne | 4/428 |
| 1,363,027 | 12/1920 | Watrous | 4/421 |
| 1,472,259 | 10/1923 | Watrous | 4/421 |
| 2,016,636 | 10/1935 | Henn | 4/421 |
| 2,110,361 | 3/1938 | Groeniger | 4/428 |
| 2,558,680 | 6/1951 | Groff | 4/331 |
| 2,878,483 | 3/1959 | Schmid . | |
| 3,224,013 | 12/1965 | Tubbs | 4/428 |
| 4,145,776 | 3/1979 | Crosby et al. | 4/425 |
| 4,159,550 | 7/1979 | Tobin, Jr. | 4/319 |

FOREIGN PATENT DOCUMENTS

| | | | |
|---|---|---|---|
| 507434 | 12/1951 | Belgium | 4/329 |
| 808085 | 1/1937 | France . | |
| 58-12953 | 3/1983 | Japan . | |
| 58-115587 | 8/1983 | Japan . | |
| 61-106584 | 7/1986 | Japan . | |
| 62-21180 | 2/1987 | Japan . | |
| 507908 | 6/1939 | United Kingdom | 4/329 |
| 1099707 | 1/1968 | United Kingdom | 4/428 |
| 1099707 | 1/1986 | United Kingdom . | |

*Primary Examiner*—Henry J. Recla
*Assistant Examiner*—Charles R. Eloshway
*Attorney, Agent, or Firm*—Greenblum & Bernstein, P.L.C.

[57] ABSTRACT

A water closet having a trap drainage exit in a wall above a floor, in which at the time of flushing, a vent space is partitioned in a wall-like manner by water falling from a weir. A rise in the water level of a sump portion of the trap results, and air within the trap is quickly forced toward the drainage exit side by the force of the water flow to cause the interior of the trap drainage to have a decreased pressure so that siphon action easily occurs. When the feed rate of water from a tank slows, to terminate the siphon action, air is promptly introduced into the siphon area from a notch in a partitioning wall, whereby the air introduction is hastened and the siphon effect is terminated quickly.

16 Claims, 3 Drawing Sheets

WATER CLOSET

This application is a continuation of application Ser. No. 08/332,505, filed Oct. 31, 1994, now abandoned, which is a continuation of application Ser. No. 07/939,932, filed on Sep. 2, 1992, now abandoned, which is a continuation of application Ser. No. 07/660,234 filed on Feb. 25, 1991, now U.S. Pat. No. 5,170,515, which is a continuation of application Ser. No. 07/362,404, filed as PCT/JP88/00944 Sep. 16, 1988, now abandoned.

FIELD OF THE INVENTION

The present invention relates to a water closet having a drain hole above a floor.

DESCRIPTION OF THE BACKGROUND AND RELEVANT INFORMATION

A one-piece closet of a low silhouette type is known (for example, see Japanese Utility Model Application Laid-Open No. 106584/1986).

In a water closet of this kind, the height dimension of a flushing tank is adjusted to the closet body as much as possible so as to provide united impression.

Therefore, sufficient water head cannot be obtained, and the feed water momentary flow rate which is a great factor in controlling the flushing function of a closet is extremely low as compared with that of a closet of the type in which the flushing tank is mounted on the closet body and a closet of the type in which a flush valve is used as a feed device.

Generally, a closet of a wall drain type has a drain hole set to 100 to 150 mm from a floor surface in terms of execution of a closet and a function of a closet. However, when a one-piece closet of the low silhouette type employs the wall drain to secure the aforesaid drain hole height, the head from the water surface of a bowl portion to the drain hole decreases and a satisfactory function cannot be achieved with the aforementioned poor condition being present. Therefore, no one-piece closet of the wall drain type has been present in commerce so far.

On the other hand, since a water closet of a one-piece type is considered as a luxury closet, this one-piece type closet has been desired to be installed in luxury mansions, suite rooms in luxury hotels, and the like, However, in hotels, mansions and the like, ceiling beams often obstruct drain pipes, and in case of high buildings or the like, the ceiling height is often obtained by removal of piping space in the ceiling. Therefore, the conventional one-piece type water closet which employs the floor drain type wherein drain pipes need be installed under the floor cannot satisfy the above-described demand of the market.

SUMMARY OF THE INVENTION

The problem to be solved by the present invention is that a trap drainage is made by a new construction in which a siphon tends to occur and a powerful siphon force is obtained, thereby making it possible to provide a wall drain for a one-piece type water closet.

According to the technical means provided by the present invention to solve the aforementioned problem, a drain hole of a trap drainage is formed continuously with a bowl portion of a closet body. The trap drainage has a sump portion downstream of a weir portion and has partly constricted a diameter of the trap drainage between the weir portion and the sump portion. A partitioning wall is suspended on an upper wall of said sump portion leaving a slight vent space between the upper wall and a water surface of the sump portion and the partitioning wall being provided with a notch.

With the above-described arrangement, according to the aforesaid technical means of the present invention, at the time of flushing, the vent space is partitioned in a wall-like manner by water falling from the weir portion and a rise in a water level of the sump portion occurs. The air within the trap is promptly forced toward the drain hole by the power of the water flow so that the pressure in the trap drainage becomes a pressure less than atmospheric pressure. In other words, splashing of the water, falling over the weir and into the sump, causes entrainment of some of the air with the water, and the subsequent discharge of the water with the entrained air, through the exit, causes low atmospheric pressure within the trap drainage, which results in a siphon action.

Accordingly, a siphon effect tends to occur.

Further, when feed from the tank terminates, to thus terminate the duration of the siphon effort, air is immediately introduced from the notch of the partitioning wall, and therefore, timing of air introduction becomes accelerated to promptly end the siphon effect. In other words, at the end of the flush cycle, air is introduced into the trap drainage, and this results in a rapid termination of the siphon action.

DESCRIPTION OF THE PREFERRED EMBODIMENT

Figure 1:
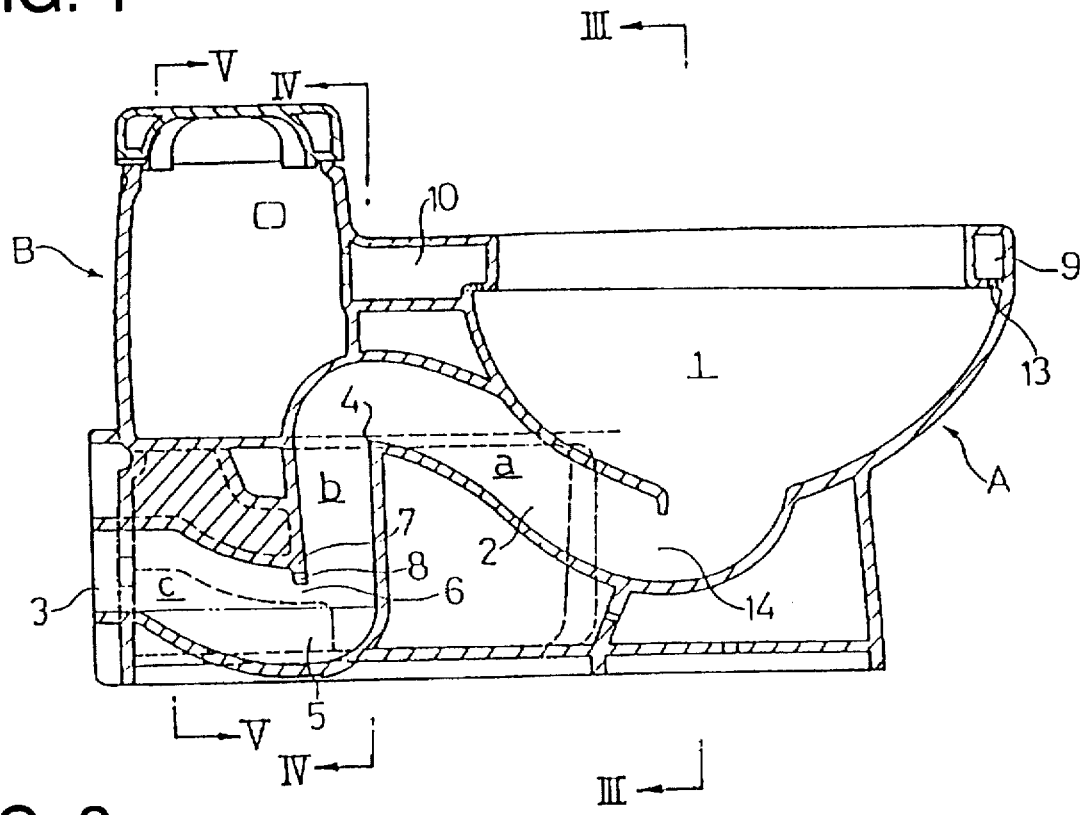
FIG. 1 is a sectional elevation view of a water closet showing one embodiment of the present invention.
Figure 2:
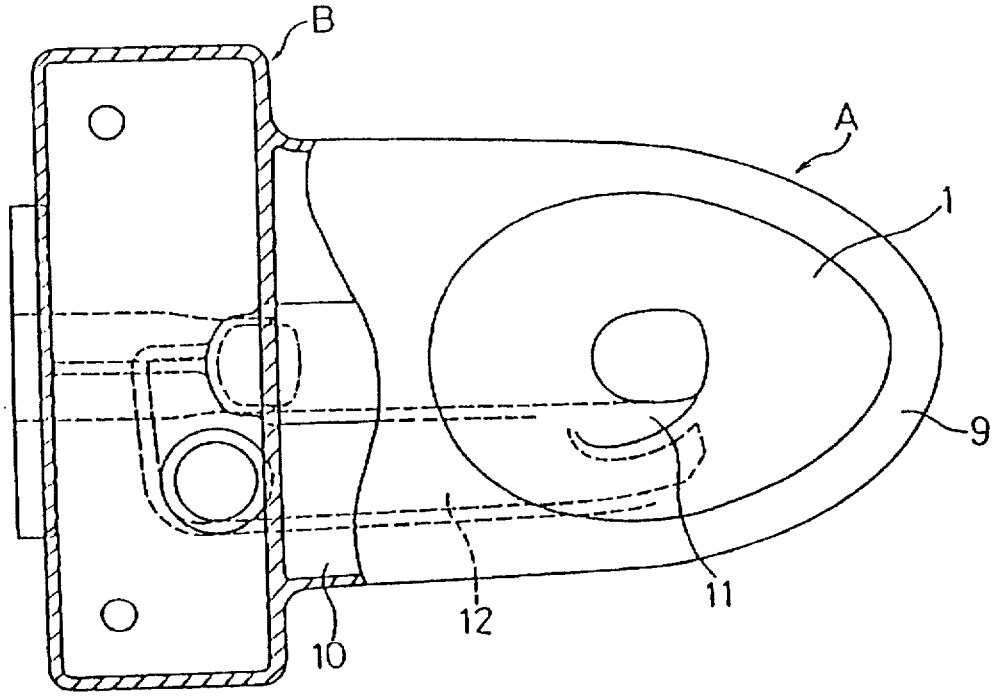
FIG. 2 is a partly cut-away plan view.
Figure 3:
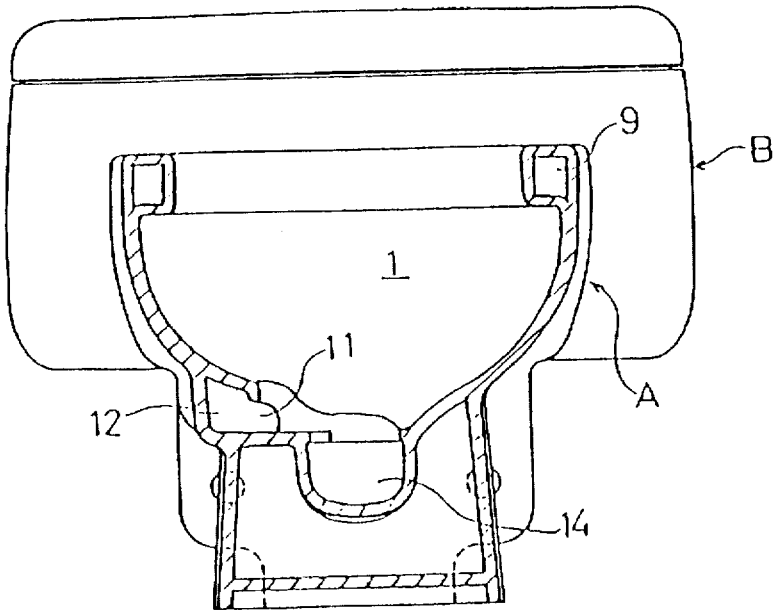
FIG. 3 is a sectional view taken on line III—III of FIG. 1.
Figure 4:
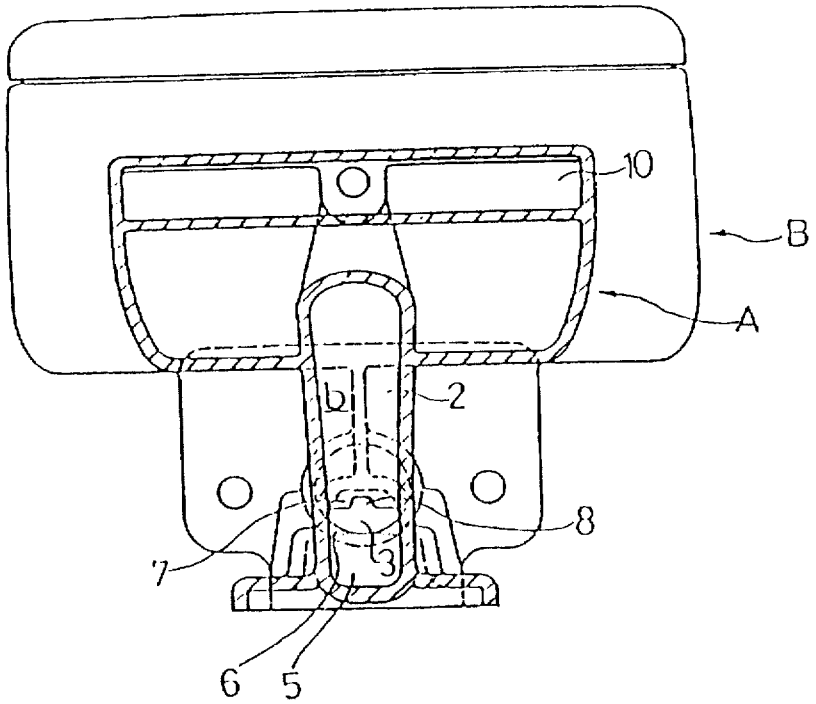
FIG. 4 is a sectional view taken on line IV—IV of FIG. 1.
Figure 5:
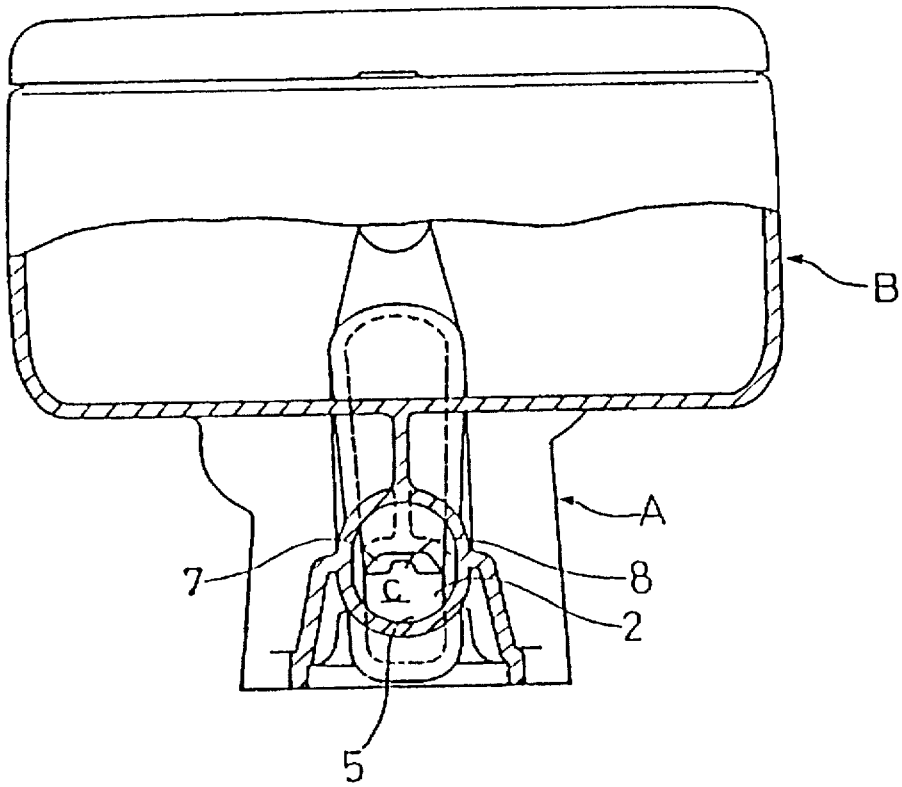
FIG. 5 is a sectional view taken on line V—V of FIG. 1.

One embodiment of the present invention will be described hereinafter with reference to the drawings.

In the drawings, reference character (A) designates the closet body, and (B) a flushing tank formed integral with the closet body at an upper half and at the rear thereof. The flushing tank (B) is formed so that a height dimension of the flushing tank (B) is adjusted to the closet body (A) as much as possible to provide a unified visual impression with the closet body (A).

In the closet body (A), a rim water passage (9) provided along the upper edge of a bowl portion (1) is in communication with an intermediate portion heightwise of the flushing tank (B) through a feed chamber (10) provided at the rear of the bowl portion (1). A discharge opening (11) is bored in the bottom side of the bowl portion (1) and is in communication with the bottom of the flushing tank (B) through a water guide passage (12) provided outside the bowl portion (1) so that a part of the flushing water within the tank (B) is supplied along the wall surface of the bowl portion 1 from a water injection hole (13) bored in the lower surface of the rim water passage (9) and the remaining and greater part thereof is spirally supplied from the discharge opening (11) to the of the bowl portion (1).

Furthermore, in the closet body (A), a trap drainage (2) for discharging the flush water supplied to the bowl portion (1) outside the closet together with sewage is provided and is in communication with the bowl portion (1).

In the trap drainage (2), an inlet (14) opens to the bottom of the bowl (1), and an outlet, that is, a drain hole (3) opens at a substantially intermediate position between the lower end of the flushing tank (B) and the lower end of the closet body (A) at the back of the closet body (A). Both the inlet and drain hole (14, 3) are in communication with each other to form a substantially S-character configuration.

That is, the trap drainage (2) is composed of a portion obliquely and upwardly extending from the inlet (14) that opens to the bottom of the bowl portion (1) toward the rear portion of the closet body (A) (hereinafter referred to as a portion a), a portion which is continuous with the upper end of said portion a, substantially vertically downwardly extending and reaching a position lower than a height positions of the inlet (14) and drain hole (3) (hereinafter referred to as a portion b), and a portion which is continuous with the portion b and obliquely and upwardly extending toward the drain hole (3) (hereafter referred to as a portion c). The bottom wall at the upper end of the portion a forms a weir portion (4).

In the trap drainage (2), a diameter of the portion b is gradually reduced downwardly to partially narrow the diameter of the drain hole and forms a sump portion (5) extending from the lower end of the portion b to the halfway portion of the portion c.

Moreover, in the trap drainage (2), a downwardly extending partitioning wall (7) is formed on the upper wall of the sump (5), more specifically, on the upper wall of a boundary portion between the portions b and c so as to leave a slight vent space (6) between the lower end of the partitioning wall and a water surface or level of the sump (5).

The partitioning wall (7) is provided with a notch (8) having a suitable depth from the lower end thereof to the heightwise mid-portion.

The optimum dimension of the vent space (6) is approximately 20 mm in order to induce siphon.

While in the above-described embodiment, the closet of the low silhouette type has been described, it is to be noted that for example, a siphon or siphon-jet closet may be adapted from the above description.

OPERATION

The present invention being constructed as described above, there are the following advantages.

(1) The construction is provided in which the vent space is closed in a wall-like manner by water falling from the weir portion and causes a rise in the water level of the sump portion. Therefore, the air within the trap can be quickly forced by the water toward the drain hole to give the interior of the trap a negative pressure with respect to the atmosphere so that siphon action easily occurs. Thus, the low atmospheric pressure is caused by the exit of a portion of the air within the sump after it has been entrained with the water flowing (or falling) over the weir.

Accordingly, the water feed momentary flow rate is materially low as compared to that of a tank closely connected to a water closet or a closet using a flush valve. In addition, despite the fact that this closet is a one-piece closet of a low silhouette type, utilizing a wall drain, the height of a drain hole is set to be about 100 mm from a floor surface, a head from a water level of the bowl portion to the center of the drain hole is small, but a fully satisfactory sewage discharge function can be obtained with a wall drain type installation.

Thereby, the closet of the present invention can be installed without any trouble in high buildings, luxury mansions, luxury hotels and the like in which the ceiling beams obstruct underfloor piping and often lack piping spaces in the ceiling, thus making it difficult to install a one-piece closet of a low silhouette type. The closet of the present invention can satisfy with the demand of markets.

(2) By providing the notch on the partitioning wall, when feed of water from the flushing tank terminates so as to terminate the siphon action, air can be promptly introduced from the notch into the trap, and therefore, the siphon can be quickly terminated to provide a water level in the bowl portion, and the depth of seal water can be returned to its original state due to the trap seal. Thus, the air-admitting notch serves to quickly terminate the siphon action and to end the discharge of water from the water closet.

Incidentally, if a notch is not provided in a partitioning wall, siphon termination time remarkably extends due to the rise in water level of the sump portion and the falling water from the weir portion to make it difficult to secure the depth of sealed water.

It is noted that since at the start of siphon action, a water film is formed by the water falling from the weir portion, the aforesaid notch will not have an influence on siphon start time and strength of siphon.

We claim:

1. A water closet comprising:

a flushing tank;

a water closet body including a bowl portion, wherein said flushing tank is formed integrally with said bowl portion and at least a portion of said tank extends below an upper portion of said bowl portion, said water closet further comprising:

a feed chamber which feeds water from said flushing tank to said bowl portion, said feed chamber interconnecting with said flushing tank substantially intermediately heightwise of said flushing tank;

a trap drainage formed continuously with said bowl portion and having a drain hole, said drain hole of said trap drainage and a rear wall of said closet body being positioned substantially in a same plane with a rear surface of said flushing tank, and said trap drainage further comprising a sump portion downstream of a weir portion, and a partitioning wall on an upper wall above said sump portion; wherein said partitioning wall creates a slight vent space between said upper wall and a water surface of said sump portion.

2. A water closet as recited in claim 1, wherein a portion of said trap drainage extends substantially horizontally from said drain hole and said rear wall surface of said closet body.

3. A water closet as recited in claim 1, wherein said rear wall surface is defined by a substantially vertically extending rear wall, said drain hole being formed in said rear wall above the floor upon which said water closet is supported.

4. The water closet of claim 1, a substantial portion of said integral flushing tank extending below an upper portion of said bowl portion.

5. The water closet of claim 1, wherein said drain hole is located beneath said flushing tank.

6. The water closet of claim 1, wherein said drain hole is formed in said rear wall of said closet body substantially intermediate of a lower end of said flushing tank and a bottom surface of said closet body which is adapted to be supported by a floor surface.

7. A water closet as recited in claim 1, further comprising:

a discharge opening bored in a bottom side of said bowl portion for delivering a majority of the flushing water stored in said flushing tank to a bottom area of said bowl portion.

8. A water closet as recited in claim 7, wherein said discharge opening spirally supplies flushing water to said bottom area of said bowl portion.

9. A water closet as recited in claim 7, further comprising:

a water guide passage provided outside of said bowl portion, said water guide passage connecting said flushing tank with said discharge opening.

10. A water closet as recited in claim 1, further comprising:

a rim water passage provided along an upper edge of said bowl portion.

11. A water closet as recited in claim 1, wherein said partitioning wall further comprises an air admitting notch at a lower portion thereof.

12. A water closet in which a flushing tank is formed integrally with a bowl portion of a water closet body, and a feed chamber which feeds water from said flushing tank to said bowl portion, said feed chamber interconnecting with said flushing tank substantially intermediately heightwise of said flushing tank, wherein at least a portion of said tank extends below an upper portion of said bowl portion, said water closet comprising a trap drainage formed continuously with said bowl portion and having a drain hole formed in a rear wall of said closet body substantially intermediate of a lower end of said flushing tank and a bottom surface of said closet body which is adapted to be supported by a floor surface, said drain hole of said trap drainage and said rear wall of said closet body being positioned substantially flush with a rear surface of said flushing tank, and said trap drainage further comprising a first rearwardly extending portion starting at a bottom of said bowl portion and extending rearwardly and upwardly from said bowl portion, a second portion connected to and extending substantially vertically downwardly from said first portion and extending into a third portion, said third portion connected to said second portion and comprising a sump portion at an end of said third portion connected to said second portion, said drain hole provided at an end of said third portion remote from said bowl portion of said water closet, wherein said second portion has a diameter that narrows from a first end adjacent said first portion towards a second end adjacent said third portion, and further comprising a partitioning wall on an upper wall above said sump portion; wherein said partitioning wall creates a slight vent space between said upper wall and a water surface of said sump portion; said partition wall being provided with an air admitting notch at a lower portion thereof, said trap drainage having first and second water seals provided at the juncture of said first and second portion of said trap drainage and at said partitioning wall, said drainage hole from said third portion of said trap drainage having a generally continuous periphery.

13. A water closet as recited in claim 12, further comprising:

a rim water passage provided along an upper edge of said bowl portion.

14. A water closet comprising:

a bowl portion having a horizontal rim surface and a water exit opening at a lower portion of said bowl portion;

a trap drainage; and a drain hole formed in said water closet, wherein said trap drainage comprises:

an upper portion extending from said water exit opening;

a sump portion connecting to said drain hole;

an intermediate portion interconnecting said upper portion and said sump portion, said intermediate portion including a weir portion connected to said upper portion at an entrance of said intermediate portion, said intermediate portion extending downwardly substantially perpendicular to said rim surface; and a partitioning wall extending downwardly from an upper wall of said sump portion and terminating at an end above a static water level in said sump portion, said partitioning wall creating a slight vent space between said partitioning wall end and said static water level across the entire width of said sump portion prior to initiation of a flush cycle.

15. A water closet as recited in claim 14, wherein said drain hole is formed in a side peripheral surface of a lower portion of said water closet, above a floor level thereof.

16. A water closet as recited in claim 14, further comprising:

a flushing tank for supplying water to said bowl portion, said flushing tank comprising a drain hole located substantially vertically midway of said flushing tank.

* * * * *